US006428130B1

(12) United States Patent
Banicevic et al.

(10) Patent No.: US 6,428,130 B1
(45) Date of Patent: Aug. 6, 2002

(54) REFRIGERATOR MULLION

(75) Inventors: Nedo Banicevic, Hamilton; Muc Dang, Burlington, both of (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/963,445

(22) Filed: Sep. 27, 2001

(30) Foreign Application Priority Data

Feb. 27, 2001 (CA) ..... 2338807

(51) Int. Cl.[7] ..... A47B 96/04
(52) U.S. Cl. ..... 312/407; 312/296
(58) Field of Search ..... 312/116, 296, 312/400, 401, 406, 407, 407.1; 62/441, 447; 220/592.01, 592.02, 592.09

(56) References Cited

U.S. PATENT DOCUMENTS

| | | | | |
|---|---|---|---|---|
| 3,697,723 A | | 10/1972 | Winsler et al. | |
| 4,150,518 A | | 4/1979 | Truesdell et al. | |
| 4,330,310 A | | 5/1982 | Tate, Jr. et al. | 62/275 |
| 4,550,576 A | | 11/1985 | Tate, Jr. et al. | 62/441 |
| 4,821,399 A | * | 4/1989 | Markley et al. | 312/407 X |
| 4,884,415 A | | 12/1989 | Mandel et al. | 62/277 |
| 4,955,676 A | | 9/1990 | Weaver et al. | 312/214 |
| 5,255,531 A | | 10/1993 | Williams et al. | 62/277 |
| 5,349,832 A | | 9/1994 | Johnson et al. | 62/447 |
| 5,645,330 A | | 7/1997 | Artwohl et al. | 312/116 |
| 6,036,294 A | | 3/2000 | Banicevic et al. | 312/407 |
| 6,290,314 B1 | * | 9/2001 | Kim | 312/407 |

* cited by examiner

*Primary Examiner*—James O. Hansen

(57) ABSTRACT

A mullion assembly for a refrigerator cabinet has a pair of adjacent edge wall insulating gasket members extending toward the open side of the cabinet. The edge wall members each have a forward surface extending flush to the open side for supporting a portion of a door sealing gasket and a recessed channel extending rearwardly of the open side. One of the edge wall members has a locating flange member with an edge portion extending toward the other one of the edge wall members. A metallic mullion bar extends between the pair of edge wall members and has a flat wall portion against which seals another portion of the door sealing gasket carrying a magnet. The mullion bar has rearwardly extending flanges extending into and supported by a respective one of the recessed channels of the edge wall members. A block of fiberglass insulation is mounted rearwardly of the metallic mullion bar within the space between the interior cavities. The insulation member is held in engagement by and between the pair of edge wall members by the locating flange member edge portion urging the insulation member against the other edge wall member. This assembly has reduced thermal transfer from outside ambient to the interior cavity of the cabinet through the metallic mullion bar.

13 Claims, 3 Drawing Sheets

REFRIGERATOR MULLION

FIELD OF THE INVENTION

The present invention relates generally to refrigerator cabinets and in particular relates to a mullion assembly having an enhanced energy saving construction.

BACKGROUND OF THE INVENTION

In the construction of a refrigerator cabinet, it is typical to include a metal mullion bar position between side walls of a horizontally disposed freezer and fresh food compartment or between the top and bottom walls of side-by-side freezer and fresh food compartment. The purpose of the mullion bar or rail is well known to provide support between the side walls of the refrigerator and to provide a load bearing structure about which the liners of the freezer and fresh food compartment are constructed.

The mullion rails or bars are located across the open front of the refrigerator cabinet exposed to the ambient atmosphere and at least a portion of the interior liner of the freezer compartment and/or the fresh food compartment. Typically, the mullion bar provides a structural support to which a partition for the freezer and fresh food compartments are constructed. Since the mullion bar is a metallic material, the mullion is a good heat transfer medium between the ambient atmosphere and the freezer compartment and/or the fresh food compartment. When the ambient is humid, condensation appears on the face of the mullion bar when mullion temperature is below dew point temperature. To prevent sweating the mullion bar typically has a heater which warms the mullion surface exposed to the ambient. However these heaters also heat the fresh food compartment and/or freezer compartment raising the energy requirements needed to maintain operation of the refrigerator.

The mullion bar also provides a reinforced surface against which the doors may close. Each door includes a gasket having magnets which are attracted to the metal mullion bar to effect a seal against the mullion bar. Thus the mullion bar is required to provide an effective seal against the door gaskets which must withstand the stresses of repeated door closure and provide a magnetic attracting medium.

There is a need however for a mullion bar assembly for use in a refrigerator where the metallic bar exposed to the ambient contacts only a portion of the door seal and another portion of the door seal further engages a portion of the interior cabinet or gasket associated therewith that is insulated from the metallic mullion bar. There is a further need to provide a mullion bar assembly that has improved thermal insulation characteristics that inhibit thermal transfer between the fresh food or freezer compartments and the ambient exposed mullion bar.

SUMMARY OF THE INVENTION

The present invention relates to a refrigerator cabinet having improved heat transfer characteristics associated with the mullion. Preferably, a metallic reinforcing mullion rail or bar is located between the freezer compartment and fresh food compartment of an interior plastic liner. The metallic mullion bar is held in place by plastic insulated edge wall gasket members which together with the mullion bar form the front wall of the mullion assembly. The edge wall gasket members have an additional function of holding a block of insulation behind the mullion strap to further reduce thermal heat transfer to the mullion bar.

In accordance with one aspect of the present invention there is provided a refrigerator including a refrigerator cabinet comprises an exterior metallic cabinet shell having a top wall, a bottom wall and side walls providing an open side. The cabinet has an interior liner adapted to fit within the exterior cabinet shell. The interior liner defines two interior cavities with a space therebetween. The cabinet has an energy efficient mullion assembly interconnecting the two interior cavities at the open side. The mullion assembly comprises the interior cavities each having adjacent edge wall members extending toward the open side of the cabinet. The edge wall members each have a forward surface extending flush to the open side for supporting a portion of a door sealing gasket. The edge wall members each has a recessed channel extending rearwardly of the open side. At least one of the edge wall members has a locating flange member with an edge portion extending toward the other one of the edge wall members. A metallic mullion bar extends between the pair of edge wall members and has a flat wall portion against which seals another portion of the door sealing gasket carrying a magnet. The mullion bar has rearwardly extending flanges extending into and supported by a respective one of the recessed channels of the edge wall members. The mullion assembly further includes an insulation member mounted rearwardly of the metallic mullion bar within the space between the interior cavities. The insulation member is held in engagement by and between the pair of edge wall members by the at least one locating flange member edge portion urging the insulation member against the other edge wall member.

By locating the insulation member between and by the insulating gaskets, thermal transfer is reduced from the interior cavities of the cabinet to the metallic mullion bar. Further, by supporting the mullion bar separate of the interior cavities, there is a reduction of heat transfer.

Preferably, the mullion assembly further includes a layer of mastic material positioned between the metal mullion flat wall portion and the insulation member and refrigerant tubing extending within the mastic material and into the insulation member for distributing and maintaining temperature of the metallic mullion flat wall portion above the dew point.

Preferably, the edge wall members are separate gaskets attached to a wall of the interior cavities. Preferably, the recess channels extend rearwardly at 90 degrees from the front forward surface. The recess channels are preferably defined by an outer wall adjacent the respective interior cabinet and an inner wall adjacent the insulation member and wherein one of the inner walls includes the locating flange member edge portion.

The insulation member preferably comprises a block of fiberglass insulation and foamed-in-place insulation is further provided within the space between the two interior cavities and rearwardly of the insulation member.

BRIEF DESCRIPTION OF THE DRAWINGS

For a better understanding of the nature and objects of the present invention reference may be had by way of example to the accompanying diagrammatic drawings in which.

DETAILED DESCRIPTION OF EMBODIMENTS

Figure 1:
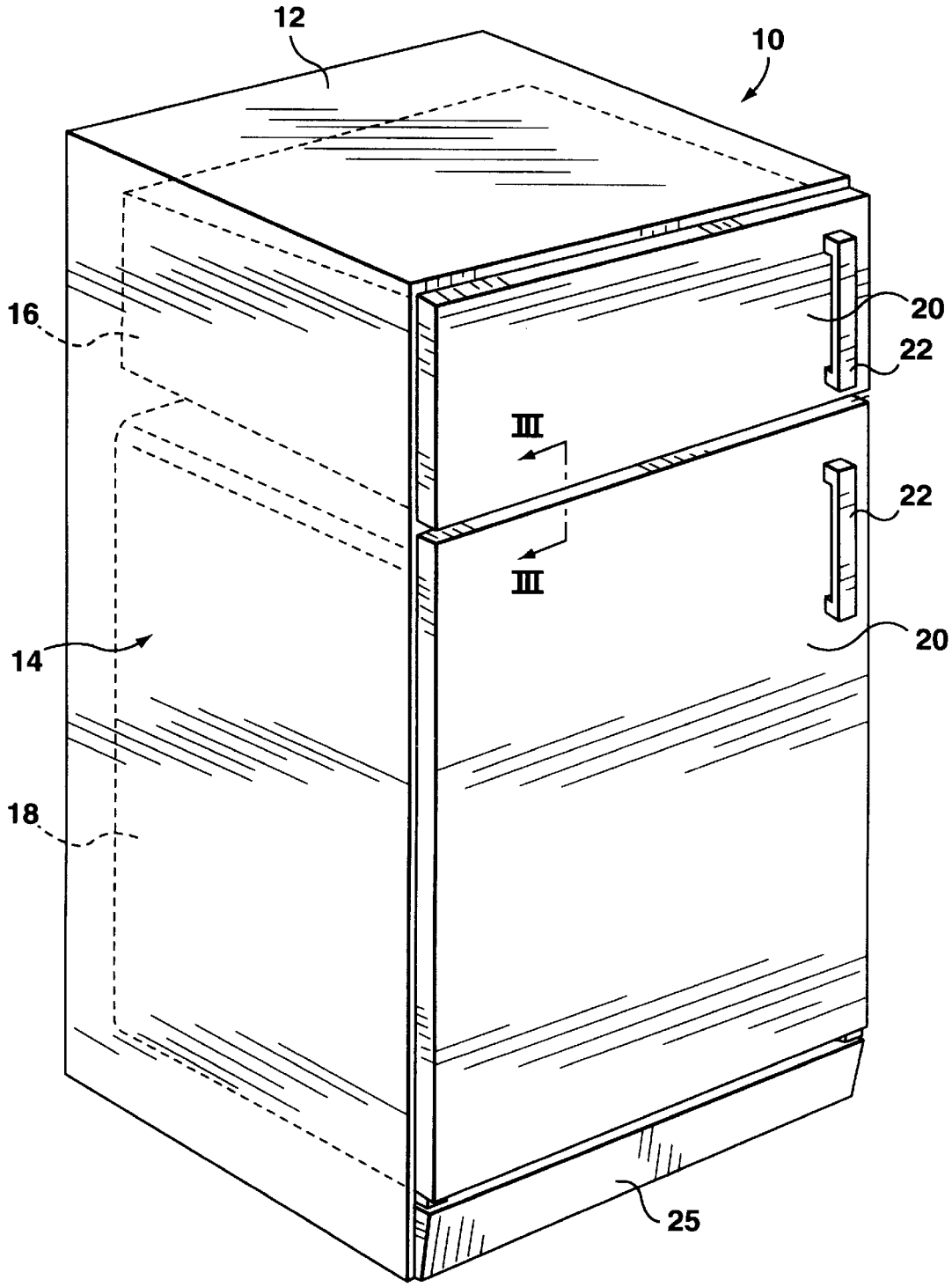
FIG. 1 is a perspective view of a refrigerator.
Figure 2:
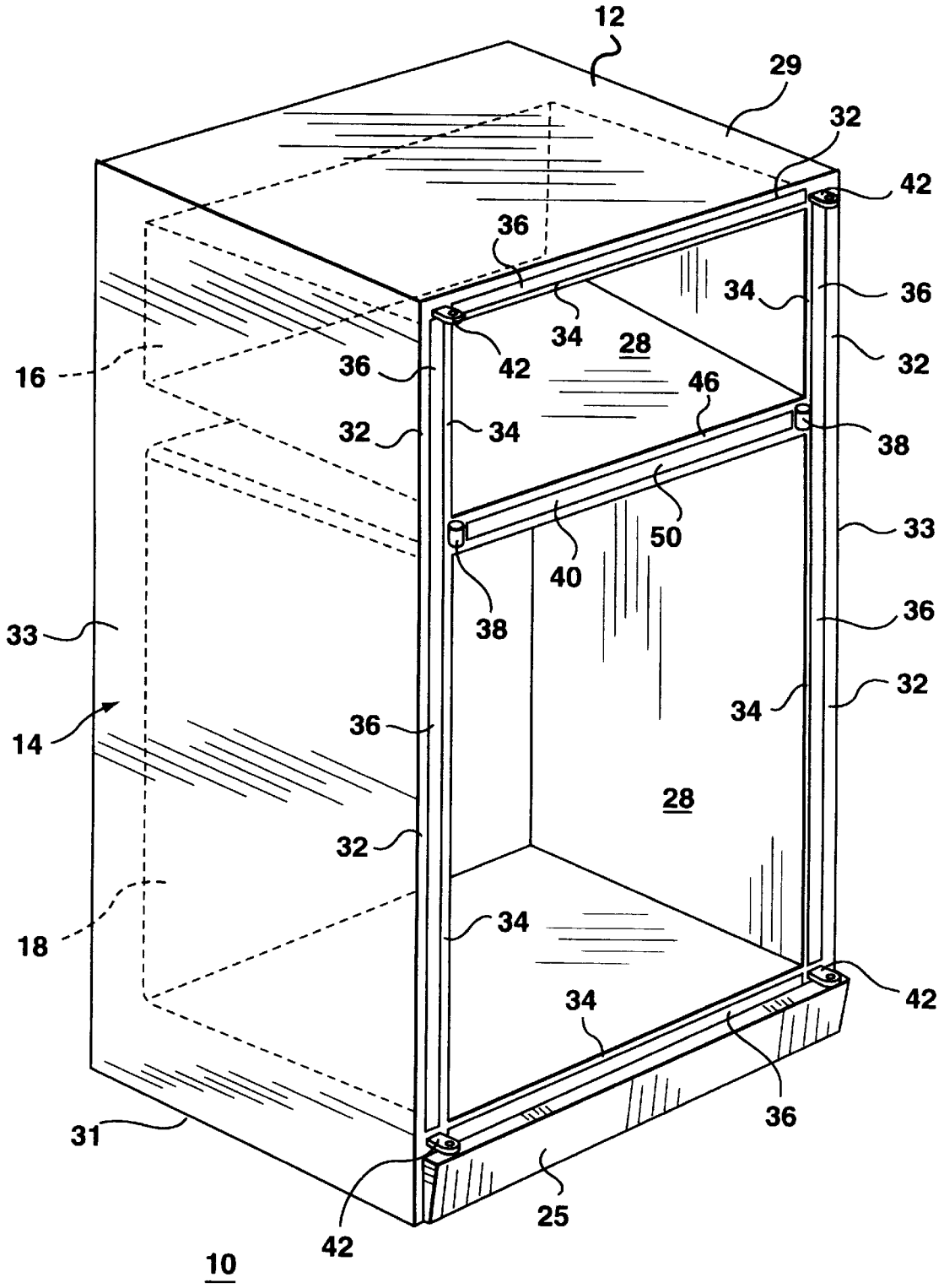
FIG. 2 is a perspective view of the refrigerator cabinet of the present invention with the doors removed.

Referring to FIGS. 1 and 2, there is shown a domestic refrigerator 10 having an exterior cabinet shell 12. The refrigerator 10 includes an interior liner 14. Interior liner 14 includes two bubble sections or cavities (16, 18) defining an upper freezer compartment 16 and a lower fresh food compartment 18. Access to the freezer compartment 16 and the fresh food compartment 18 is permitted at the front of the refrigerator 10 by opening doors 20. Doors 20 have handles 22 which facilitate opening of the doors 20 which swing open. The bottom of the refrigerator 10 has a decorative kick plate 25. It should be understood that while FIGS. 1 and 2 relate to a top mount refrigerator having an upper freezer compartment and lower food compartment, the present invention may be used in different types of refrigerator constructions, such as, for example, bottom mount refrigerators or side-by-side refrigerators having swinging or pull-out doors.

Referring to FIG. 2, the exterior cabinet shell 12 has a shell edge flange 32 extending around the open side 28 of the top wall 29, bottom wall 31 and side walls 33 towards the opening of the open side 28. The exterior cabinet shell 12 is usually made from sheet metal.

The interior liner 14 is adapted to fit within the exterior cabinet shell 12. The interior liner includes a liner flange 34 extending outwardly of said liner. The liner flange 34 is shown to extend outwardly of the top, bottom and side walls of the liner 14. The liner 14 is preferably a plastic material made from a mold. A breaker strip 36 interconnects the interior liner 14 with the exterior cabinet shell 12. Preferably, however, the plastic liner is inserted inside a recess in the flange 32 without the use of a breaker strip. The cabinet flange and the liner further include openings through which hinges 38 (see FIG. 2) extend for the mounting of the refrigerator doors 20. Separating the fresh food compartment 18 from the freezer compartment 16 of the liner 14 is the mullion assembly 40 as shown in FIG. 2.

Figure 3:
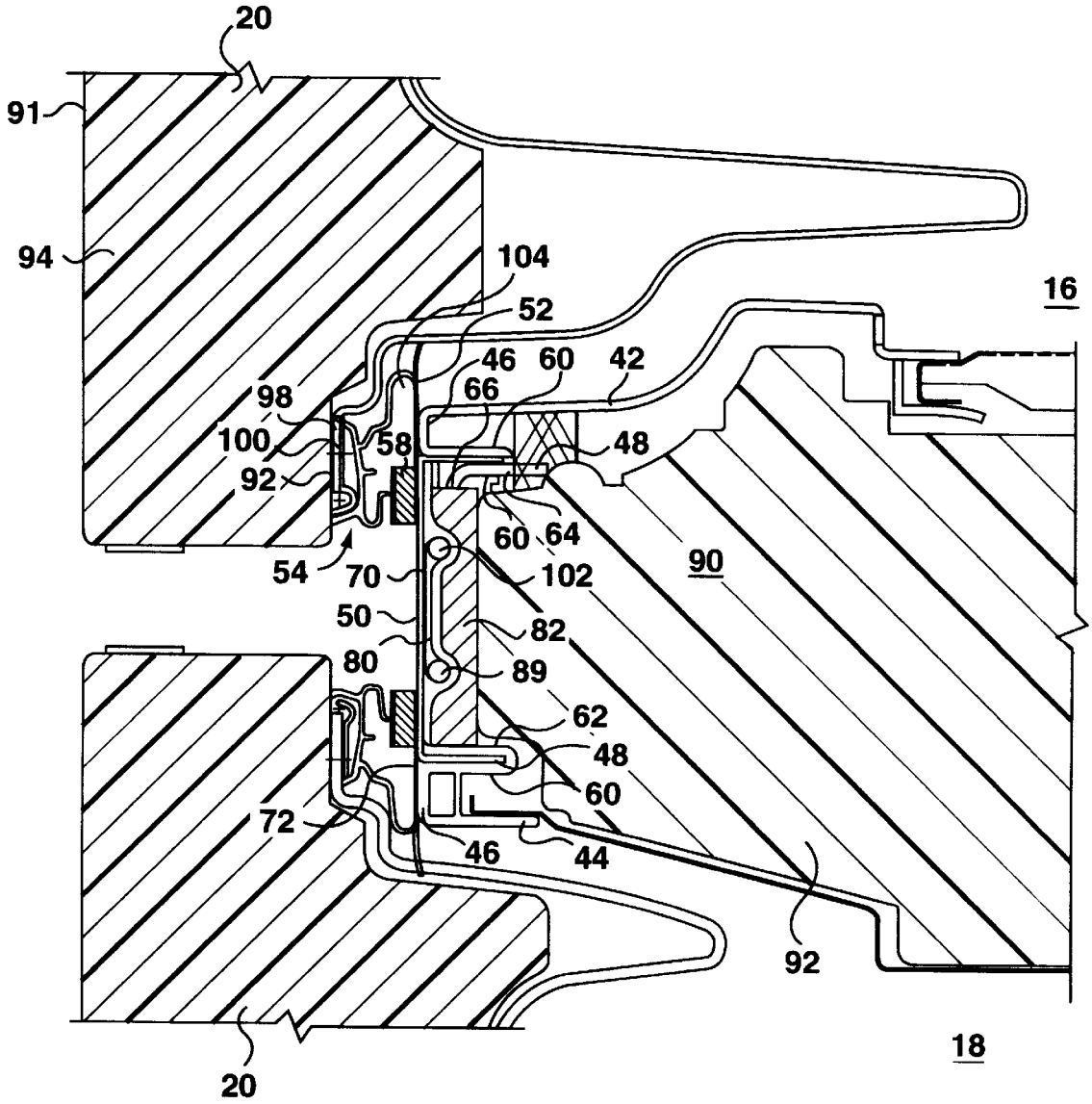
FIG. 3 a sectional view of the mullion construction of the present invention as seen along section III—III of FIG. 1.

In accordance with the novel features of the present invention, reference is now made to FIG. 3 of the drawings for a complete description of the mullion assembly 40. The mullion assembly 40 has a pair of edge wall insulated members 42, 44 each connected to a respective interior cavity 16, 18 adjacent the mullion assembly 40. The edge wall members 42, 44 each extend forward toward the open side 28 of the cabinet 12 and each have a forward surface 46 extending flush to the open side 28 for supporting a portion 52 of a door sealing gasket 54. The plastic wall members 42, 44 have a recessed channel 48 extending rearwardly of the open side 28. The recess channels 48 are defined by an outer wall 60 adjacent the respective interior cabinet 48 and an inner wall 62. The recess channels 48 extend rearwardly at 90 degrees from the open side 28.

The upper most edge wall member 42 has a locating flange member 64 with an edge portion 66 extending toward the other one of the edge wall members 44.

The mullion assembly 40 has a metallic mullion bar 50 extending between the pair of edge wall members 42, 44. The mullion bar 50 has a flat wall portion 70 against which seals another portion 56 of the door sealing gasket 54 carrying a magnet. The mullion bar 50 also has rearwardly extending flanges 72 extending into and supported by a respective one of the recessed channels 48 of the edge wall members 42, 44. The flanges 72 are inserted into the recess channels 48 and form an interference fit therewith.

A layer of mastic material 80 is applied to the inner surface of the mullion bar 50. The mastic material 80 is a thermal mass that maintains and evenly distributes heat between the metallic mullion flat wall portion 70 and insulation member 82. The heat is generated from refrigerant tubing 102 extending within the mastic material 80 and into the insulation member 82 for maintaining temperature of the metallic mullion flat wall portion 70 above the dew point. The tubes 102 are wrapped in aluminum or copper foil 89 to enhance heat transfer from tubes to mullion flat surface.

The insulation member 82 is mounted rearwardly of the metallic mullion bar 50 and mastic material 80 within the space 90 between the interior cavities. The insulation member 82 is preferably a block of fiberglass insulation and is held in engagement by and between the pair of edge wall members 42, 44 by the locating flange member edge portion 66 urging the insulation member against the inner wall 62 of the other edge wall member 44.

Lastly, the construction of the mullion assembly 40 may preferably include foamed-in-place insulation 92 within the space 90 between the two interior cavities 16, 18 and rearwardly of the insulation member 82 or could be made of an extruded expanded polystyrene as an insulator between interior cabinets 16 and 18.

In FIG. 3, the doors 20 are shown to comprise an exterior shell 90 having an inturned flange 92. Within the door 20 is insulating foam 94. The inside of the door is provided with a door liner 96 having an outwardly turned flange 98. The outwardly turned flange 98 is provided with a hook 100 for effecting a clasping motion with a door sealing 54. This hook in an alternative embodiments is formed as an integral part of the edge of door liner. The gasket 54 is provided with a web which holds an elongate magnet 58 in an elongated magnet chamber. Adjacent the magnet chamber is a second air chamber 104.

What is claimed is:

1. A refrigerator including a refrigerator cabinet comprising:

(a) an exterior metallic cabinet shell having a top wall, a bottom wall and side walls providing an open side;

(b) an interior liner adapted to fit within the exterior cabinet shell, said interior liner defining two interior cavities with a space therebetween, (c) an energy efficient mullion assembly interconnecting the two interior cavities at the open side, the mullion assembly comprising:

(i) the interior cavities each having adjacent edge wall members extending toward the open side of the cabinet, the edge wall members each having a forward surface extending flush to the open side for supporting a portion of a door sealing gasket and each having a recessed channel extending rearwardly of the open side, and at least one of the edge wall members having a locating flange member with an edge portion extending toward the other one of the edge wall members;

(ii) a metallic mullion bar extending between the pair of edge wall members having a flat wall portion against which another portion of the door sealing gasket carrying a magnet seals, the mullion bar having rearwardly extending flanges extending into and supported by a respective one of the recessed channels of the edge wall members; and, (iii) an insulation member mounted rearwardly of the metallic mullion bar within the space between the interior cavities, the insulation member being held in engagement by and between the pair of edge wall members by the at least one locating flange member edge portion urging the insulation member against the other edge wall member.

2. The refrigerator of claim 1 further including a layer of mastic material positioned between the metal mullion flat wall portion and the insulation member, and refrigerant tubing extending within the mastic material and having a foil wrapped about the tubing in contact with the mullion flat wall portion and the mastic material co-operating to maintain temperature of the metallic mullion flat wall portion above the dew point.

3. The refrigerator of claim 1 wherein the recess channels extend rearwardly at 90 degrees from the front forward surface.

4. The refrigerator of claim 1 wherein the recess channels are defined by an outer wall adjacent the respective interior cavities and an inner wall adjacent the insulation member and wherein one of the inner walls includes the locating flange member edge portion.

5. The refrigerator of claim 1 wherein the insulation member comprises a block of fiberglass insulation.

6. The refrigerator of claim 1 further including a selected one of foamed-in-place insulation and expanded polystyrene within the space between the two interior cavities and rearwardly of the insulation member.

7. A refrigerator including a refrigerator cabinet comprising:

(a) an exterior metallic cabinet shell having a top wall, a bottom wall and side walls providing an open side;

(b) an interior plastic liner adapted to fit within the exterior cabinet shell, said interior liner defining two interior cavities with a space therebetween, (c) an energy efficient mullion assembly interconnecting the two interior cavities at the open side, the mullion assembly comprising:

(i) a pair of edge wall insulated gasket members each connected to a corresponding interior cavity adjacent the mullion assembly; the edge wall gasket members each extending forward toward the open side of the cabinet and each having a forward surface extending flush to the open side for supporting a portion of a door sealing gasket and each having a recessed channel extending rearwardly of the open side, and at least one of the edge wall members having a locating flange member with an edge portion extending toward the other one of the edge wall members;

(ii) a metallic mullion bar extending between the pair of edge wall members having a flat wall portion against which another portion of the door sealing gasket carrying a magnet seals, the mullion bar having rearwardly extending flanges extending into and supported by interference fit with a respective one of the recessed channels of the edge wall members; and, (iii) an insulation member mounted rearwardly of the metallic mullion bar within the space between the interior cavities, the insulation member being held in engagement by and between the pair of edge wall members by the at least one locating flange member edge portion urging the insulation member against the other edge wall member.

8. The refrigerator of claim 7 wherein the recess channels are defined by an outer wall adjacent the respective interior cavities cabinet and an inner wall adjacent the insulation member and wherein one of the inner walls includes locating flange member edge portion.

9. The refrigerator of claim 8 wherein the recess channels extend rearwardly at 90 degrees from the open side.

10. The refrigerator of claim 8 further including a layer of mastic material positioned between the metallic mullion flat wall portion and the insulation member, and refrigerant tubing extending within the mastic material and having a foil wrap in contact with the mullion flat wall portion and the mastic material for maintaining the temperature of the metallic mullion flat wall portion above the dew point.

11. The refrigerator of claim 10 wherein the insulation member comprises a block of fiberglass insulation.

12. The refrigerator of claim 11 further including a selected one of foamed-in-place insulation and expanded polystyrene within the space between the two interior cavities and rearwardly of the insulation member.

13. The refrigerator of claim 7 further including a pair of doors mounted to the cabinet for movement relative thereto and each of the doors adapted to close the open side of one of the interior cavities, each door carrying a seal with the one portion adapted to engage the forward surface of one of the edge wall members and the other portion carrying the magnet portion for engaging the metallic mullion flat portion.

* * * * *